US009282836B2

(12) United States Patent
Nishijima et al.

(10) Patent No.: US 9,282,836 B2
(45) Date of Patent: Mar. 15, 2016

(54) EASY-OPEN FLIP TOP LID FOR A PORTABLE WATER DISPENSER

(71) Applicant: Brita LP, Oakland, CA (US)

(72) Inventors: Rick T. Nishijima, Pleasanton, CA (US); Daniel C. Nunez, Newark, CA (US); Brett McIntire, Pleasanton, CA (US); Jessica L. Todd, Pleasanton, CA (US)

(73) Assignee: BRITA LP, Oakland, CA (US)

( * ) Notice: Subject to any disclaimer, the term of this patent is extended or adjusted under 35 U.S.C. 154(b) by 40 days.

(21) Appl. No.: 13/945,447

(22) Filed: Jul. 18, 2013

(65) Prior Publication Data

US 2015/0021363 A1 Jan. 22, 2015

(51) Int. Cl.

| | |
|---|---|
| ***B65D 45/06*** | (2006.01) |
| ***B65D 47/08*** | (2006.01) |
| ***A47G 19/12*** | (2006.01) |

(52) U.S. Cl.

CPC ..... *A47G 19/12* (2013.01); *Y10T 29/4984* (2015.01)

(58) Field of Classification Search

CPC ..... C02F 1/003; B65D 45/06
USPC ..... 222/472, 473, 465.1, 572, 189.06, 23, 222/517, 556; 210/85, 282
See application file for complete search history.

(56) References Cited

U.S. PATENT DOCUMENTS

| | | | | |
|---|---|---|---|---|
| 2,272,867 | A | 2/1942 | Cobel | |
| 3,321,115 | A * | 5/1967 | Rendahl | 222/505 |
| 3,558,023 | A * | 1/1971 | Yoshito | 222/556 |
| 4,655,373 | A | 4/1987 | Essen | |
| 5,242,093 | A | 9/1993 | Worrell et al. | |
| D415,922 | S | 11/1999 | Kawasaki | |
| 6,253,938 | B1 * | 7/2001 | Zaksenberg | B65D 47/0866 215/237 |
| D448,995 | S | 10/2001 | McDonald | |
| 6,318,587 | B1 * | 11/2001 | Friederich | 220/845 |
| 6,540,120 | B2 | 4/2003 | Lebowitz | |
| 6,638,426 | B1 * | 10/2003 | Fritter et al. | 210/266 |
| 6,685,055 | B2 | 2/2004 | Taylor | |
| 6,786,353 | B2 | 9/2004 | Gourand | |
| D626,779 | S | 11/2010 | Bell et al. | |
| 7,987,770 | B2 | 8/2011 | Klump et al. | |
| 8,101,076 | B2 * | 1/2012 | Moretto | 210/232 |
| 8,541,039 | B2 * | 9/2013 | Lackey et al. | 426/394 |
| 8,651,319 | B2 * | 2/2014 | Bursztein | 220/828 |

(Continued)

FOREIGN PATENT DOCUMENTS

| | | |
|---|---|---|
| WO | WO9529131 | 11/1995 |
| WO | WO2005092155 | 10/2005 |

*Primary Examiner* — Paul R Durand
*Assistant Examiner* — Charles P Cheyney
(74) *Attorney, Agent, or Firm* — Thomas C. Feix; Stacy H. Combs

(57) ABSTRACT

A cover for a portable fluid dispenser is disclosed. The cover comprises a flip lid component operable to rotate open to provide access to a liquid storage cavity of the portable fluid dispenser. It also comprises a lever operatively coupled to the flip lid component, wherein the lever comprises a press member on one end and an actuation arm on a far end of the lever opposite from the press member. A downward force applied to the press member causes the lever to rotate around a first pivot point. Further, the rotation of the lever around the first pivot point causes the actuation arm to push on the flip lid component at an actuation point, wherein the flip lid component pivots around a second pivot point and rotates open in response to a resulting force applied at the actuation point.

19 Claims, 10 Drawing Sheets

(56) References Cited

U.S. PATENT DOCUMENTS

| | | | | |
|---|---|---|---|---|
| 8,844,746 | B2 * | 9/2014 | Meyers et al. | 220/264 |
| 2002/0014502 | A1 | 2/2002 | Taylor | |
| 2002/0038804 | A1 | 4/2002 | Gourand | |
| 2006/0016834 | A1 * | 1/2006 | Palm et al. | 222/472 |
| 2006/0226064 | A1 * | 10/2006 | Beckman et al. | 210/323.1 |
| 2006/0226146 | A1 | 10/2006 | Haberman | |
| 2008/0047883 | A1 * | 2/2008 | Fedotov | 210/91 |
| 2010/0206835 | A1 * | 8/2010 | Yu | 215/355 |
| 2011/0006083 | A1 | 1/2011 | Walters et al. | |
| 2011/0056939 | A1 | 3/2011 | Taketani et al. | |
| 2011/0290753 | A1 | 12/2011 | Tuan | |
| 2013/0193144 | A1 * | 8/2013 | Bursztein | 220/212 |
| 2014/0069918 | A1 | 3/2014 | Meyers et al. | |

* cited by examiner

EASY-OPEN FLIP TOP LID FOR A PORTABLE WATER DISPENSER

FIELD OF THE INVENTION

This invention relates generally to filtering fluid dispensers and more particularly to lids for filtering fluid dispensers.

BACKGROUND OF THE INVENTION

Certain conventional water dispensers include multiple chambers and a filtering mechanism disposed in between. For example, the conventional water dispenser illustrated in FIG. 1A includes an upper chamber 103 and a lower chamber 101, with a filtering mechanism 102 in between, wherein liquids are filtered in the process of flowing from the upper chamber 103 to the lower chamber 101 through filtering mechanism 102. Other conventional dispensers may only comprise a single chamber with no filtering mechanism. Typically, conventional water dispensers, e.g. the dispenser illustrated in FIG. 1A, also comprise a cover that covers the opening to the upper chamber, and also includes a spout for pouring water from the water dispenser.

In certain conventional water dispensers, the upper chamber is filled with water by removing the cover and placing the dispenser under a running source of water. Thereafter, the upper chamber is filled with water and the cover is subsequently replaced over the container. However, this process is cumbersome, and to circumvent the inconvenience of removing and replacing the cover, certain dispensers have covers designed to remain on the dispenser during a water refill. These known dispenser covers typically include a hinged portion that is opened during a water refill. An example of one such dispenser is dispenser 115 illustrated in FIG. 1B.

However, covers for conventional water dispensers have a number of drawbacks. First, the lid comprising the hinged portion may be uncomfortable for some users to open. The user, for instance, may need to set the dispenser down to open the lid or may need to use two hands. It may also be cumbersome to maneuver the water dispenser under a faucet for a water fill when the hinged portion is in the open position. Additionally, a press member of the hinged portion of the lid may be difficult to depress resulting in the user needing to apply extra pressure unnecessarily to lift the lid and to keep it open. For example, press member 105 of lid 110 for the dispenser 115 illustrated in FIG. 1B has a curvature that results in the user needing to apply pressure in both the sideways direction towards the user and the downward direction to open lid 110 and then apply thumb pressure to keep the lid open. Further, a user would need to over-reach or under-reach with his or her thumb in order to open lid 110. Also, in certain water dispensers, a user would need to continue pushing down with his or her thumb on the press member in order to keep the lid 110 open. Or, for example, the lid 110 would not open to 90 degrees, which would prevent the user from easily filling the dispenser 115.

BRIEF SUMMARY OF THE INVENTION

Accordingly, there is a need for flip top lid assembly for a portable water dispenser that is easy to actuate, has a short and comfortable reach, has an overall low part count, and is easy to use. Additionally, there is a need for a flip top lid assembly that stays open after the lid has been actuated without requiring a user to hold down the press member of the lid assembly to keep the lid open. Further, there is a need for a flip top lid that stays open to substantially 90 degrees after it has been actuated by the user.

In one embodiment, a cover for a portable fluid dispenser is disclosed. The cover comprises a flip lid component operable to rotate open to provide access to a liquid storage cavity of the portable fluid dispenser. It also comprises a lever operatively coupled to the flip lid component, wherein the lever comprises a press member on one end and an actuation arm on a far end of the lever opposite from the press member. A downward force applied to the press member causes the lever to rotate around a first pivot point. Further, the rotation of the lever around the first pivot point causes the actuation arm to push on the flip lid component at an actuation point, wherein the flip lid component pivots around a second pivot point and rotates open in response to a resulting force applied at the actuation point.

In another embodiment, a method of assembling a cover for a portable fluid dispenser is presented. The method comprises providing a fixed lid component for the cover configured to be removably coupled to a container of the portable fluid dispenser. It also comprises coupling a flip lid component to the fixed lid component, wherein the flip lid component is operable to rotate open to provide access to a liquid storage cavity within the container. The fixed lid component forms an outer ring around the flip lid component, and the fixed lid component is substantially flush with the flip lid component when the flip lid component is in a closed position. Further, the method comprises operatively coupling a lever to the flip lid component. The lever comprises a press member on one end and an actuation arm on a far end of the lever opposite from the press member. A downward force on the press member causes the lever to rotate around a first pivot point, and a resulting rotation of the lever around the first pivot point causes the actuation arm to push on the flip lid component at an actuation point. Subsequently, the flip lid component pivots around a second pivot point and rotates open in response to a resulting force applied at the actuation point.

In a different embodiment, a portable fluid dispenser is presented. The dispenser comprises a container body defining a liquid storage cavity therein and having an open end. It also comprises a cover removably coupled to the container body, the cover extending along the open end. The cover comprises a flip lid component operable to rotate open to provide access to the liquid storage cavity of the portable fluid dispenser. It also comprises a fixed lid component, wherein the fixed lid component forms an outer ring around the flip lid component, and wherein the fixed lid component is substantially flush with the flip lid component when the flip lid component is in a closed position. Finally, the cover also comprises a lever operatively coupled to the flip lid component, wherein the lever comprises a press member on one end and an actuation arm on a far end of the lever opposite from the press member. A downward force applied to the press member causes the lever to rotate around a first pivot point. Further, the rotation of the lever around the first pivot point causes the actuation arm to push on the flip lid component at an actuation point, wherein the flip lid component pivots around a second pivot point and rotates open in response to a resulting force applied at the actuation point.

The following detailed description together with the accompanying drawings will provide a better understanding of the nature and advantages of the present invention.

BRIEF DESCRIPTION OF THE DRAWINGS

Embodiments of the present invention are illustrated by way of example, and not by way of limitation, in the figures of the accompanying drawings and in which like reference numerals refer to similar elements.

In the figures, elements having the same designation have the same or similar function.

DETAILED DESCRIPTION OF THE INVENTION

Reference will now be made in detail to the various embodiments of the present disclosure, examples of which are illustrated in the accompanying drawings. While described in conjunction with these embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

For expository purposes, the term "horizontal" as used herein refers to a plane parallel to the plane or surface of an object, regardless of its orientation. The term "vertical" refers to a direction perpendicular to the horizontal as just defined. Terms such as "above," "below," "bottom," "top," "side," "higher," "lower," "upper," "over," and "under" are referred to with respect to the horizontal plane.

Figure 2:
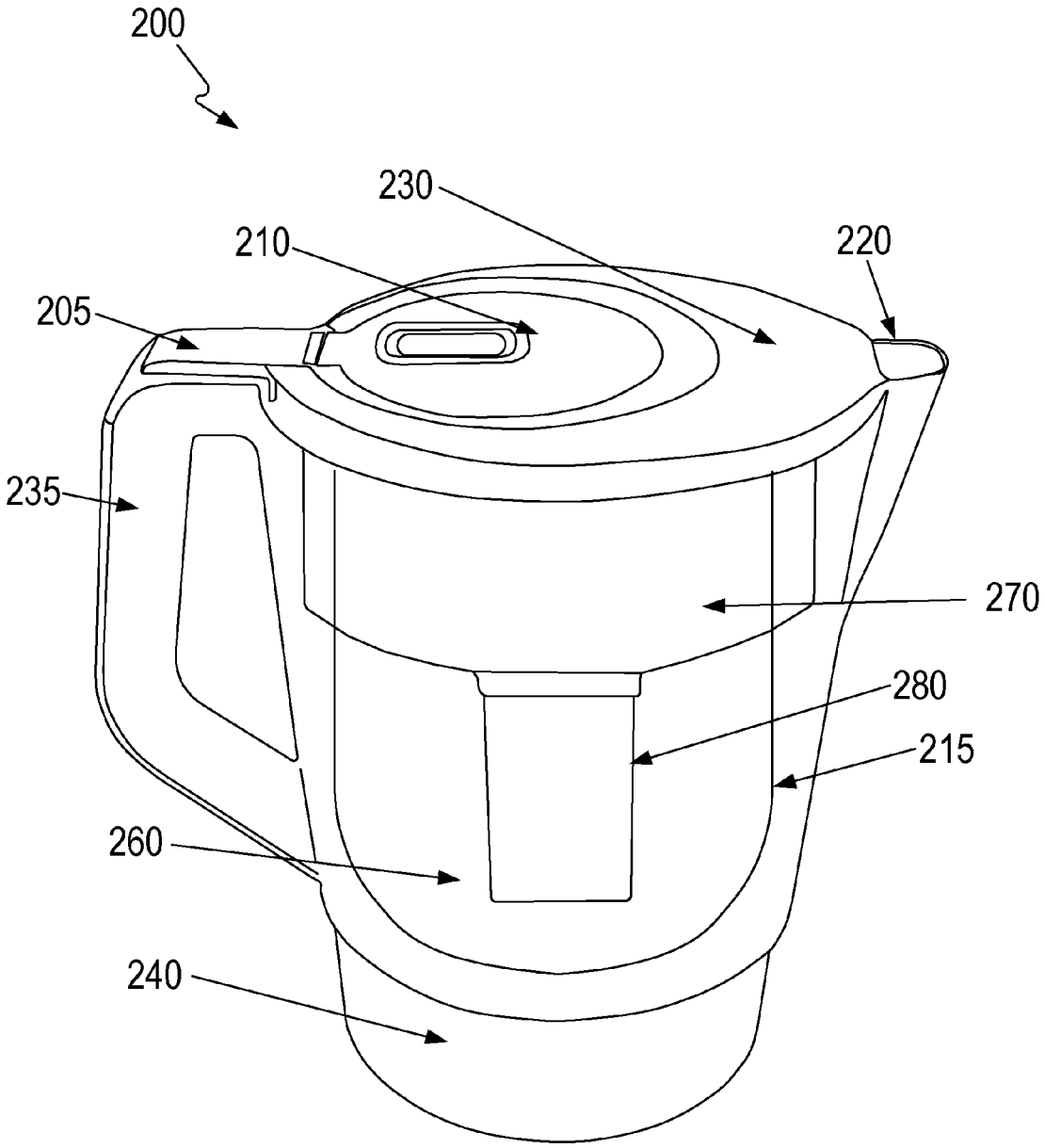
FIG. 2 is a perspective view of one embodiment of the flip top lid assembly of the present invention secured to the top of the container portion of the water pitcher.

FIG. 2 is a perspective view of one embodiment of the flip top lid assembly of the present invention secured to the top of the container portion of the water pitcher. Although intermittently referred to as a water pitcher herein, the container portion 215 of the pitcher 200 can, in one embodiment, hold and dispense any fluent substance, e.g., water. The cover of the water pitcher 215 comprises a flip lid component 210 and a fixed lid component 230, which together overlie the top of the container portion 215. Both the flip lid component 210 and the fixed lid component 230 are operatively connected to a lever 205. The fixed lid component 230 can be detached from the container body 215, but is not actuated by lever 205.

The inventive flip top lid assembly comprises the lever 205 with the flip lid component 210. The lip lid component can also be detached from the container body 215, but, unlike the fixed lid component, it is actuated by lever 205. The flip lid component 210 is a hinged part of the flip top lid assembly allowing pivoting of the lid between an open position for access to the interior of the container 215 and a closed position overlying the top of the container 215.

The water pitcher 200 can also comprises a handle 235 and a spout opening 220. The fluent substance is dispensed from the dispenser 200 using the spout opening 220. The spout opening 220 is generally positioned at a forward end of container portion 215, or the end generally away from a user. In one embodiment of the invention, the entire container portion 215, including the spout opening 220 and the handle 235, may be of molded, one-piece, plastic construction, and thus inexpensive. In another embodiment, the container portion 215 may be a different material, e.g., glass, metal etc. as well.

In one embodiment, such as the one illustrated in FIG. 2, the container portion 215 can have a circular cross section. The circular cross-section can be larger at the top than at the bottom. Accordingly, the container portion 215 can be tapered so that it is narrower towards the bottom than at the top. In a different embodiment, the container can be shaped differently, e.g., the container may have a cylindrical, oval, rectangular, or any other irregular shape. In one embodiment, the container comprises a narrower cylindrical base 240 to improve the stability of the pitcher.

In one embodiment, container body 215 is fabricated from a durable, rigid material such as a plastic material. However, in alternative embodiments, container body 215 can be fabricated from a glass material, a metal material or the like.

In one embodiment, dispenser 200 includes an upper chamber or reservoir 270 within the container portion 215. Upper chamber 270 is positioned proximate flip lid component 210, fixed lid component 230, and lever 205. A filter mechanism 280 is positioned at a lower portion of upper chamber 270. Filter mechanism 280 is positioned between upper chamber and lower chamber 260. Fluids in upper chamber 270 are separated from fluids in lower chamber 260. However, upper chamber 270 and lower chamber 260 are in fluid communication with each other via filter mechanism 280. In one embodiment of the present invention, filter mechanism 280 is a gravity or drip filter such that unpurified fluids can be channeled from upper chamber 270 through filter mechanism 280 into lower chamber 260.

It should be noted that the inventive flip top lid assembly is not limited to being used only in pitchers comprising filter mechanisms. For example, the present invention can be used in a fluid dispenser with no filter at all. In other embodiments, the design scope can also include other in-home and out-of-home water filtration formats such as countertop, faucet mount, personal water bottle or jug filters.

The handle 235, in one embodiment, may be formed integrally with the container portion and is located at one side of the container. In one embodiment, the handle 235 is located on the opposite side of the container from spout 220. In one embodiment, the handle has a generally horizontal upper portion that is flush alongside lever 205 and is secured to the upper portion of container 215. The handle 235 may also comprise a handle grip extending downwardly from the upper portion of the handle and spaced from the container at a sufficient distance so as to allow a user to grasp the handle grip with the fingers of one hand.

Figure 3:
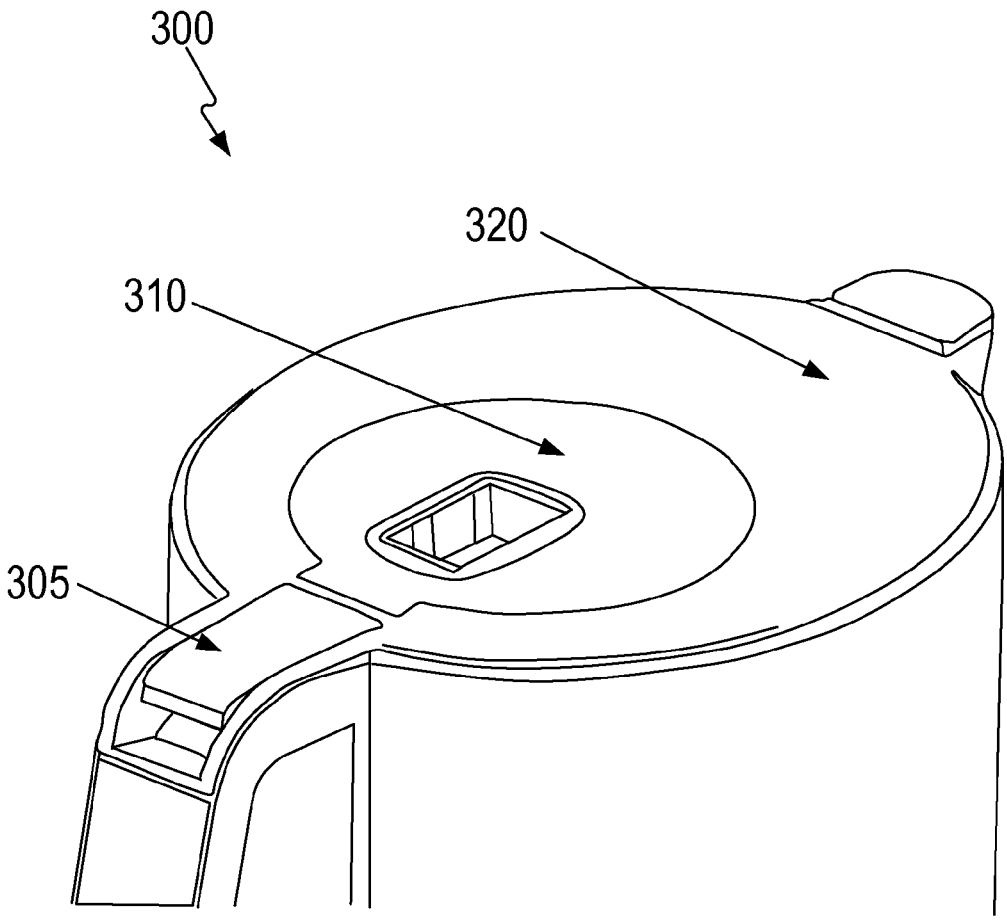
FIG. 3 is an isometric view of the flip top lid assembly of the present invention embodying the principles of the present invention.

FIG. 3 is an isometric view of the flip top lid assembly of the present invention embodying the principles of the present invention. As discussed above, in one embodiment, the lid has a flip lid component 310 and a fixed lid component 320. Both the fixed lid and flip lid components are removably coupled with container body 215. The flip lid component can, in one embodiment, be circular in shape. In different embodiments, the flip lid component can be elliptical, rectangular or the like. The fixed lid component 320, in one embodiment, can be circular in shape as well. In different embodiments, the fixed lid component can be elliptical, rectangular or the like. The lever 305 can actuate the flip lid component 310.

Figure 1A:
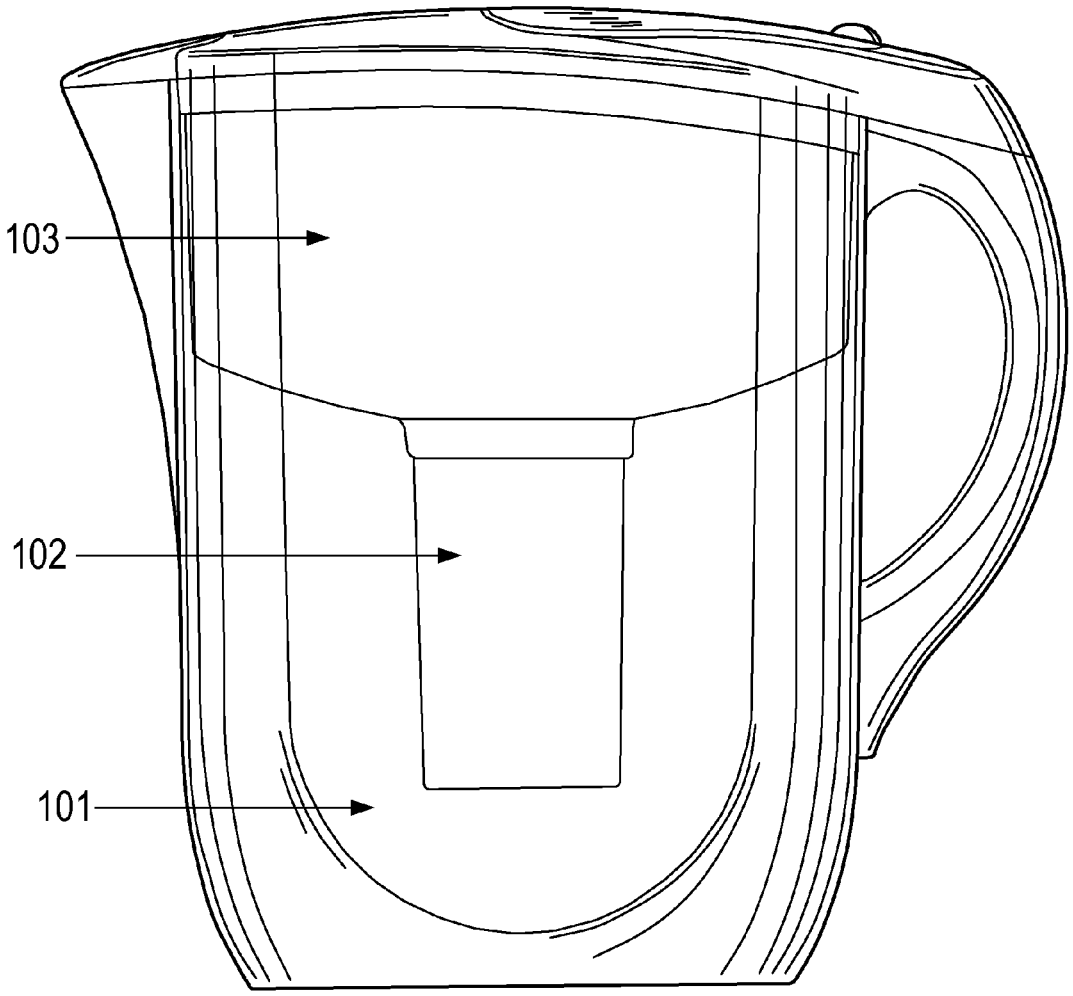
FIGURE 1A Prior Art
FIG. 1A is an illustration of a conventional water dispenser with a filtering mechanism.
Figure 1B:
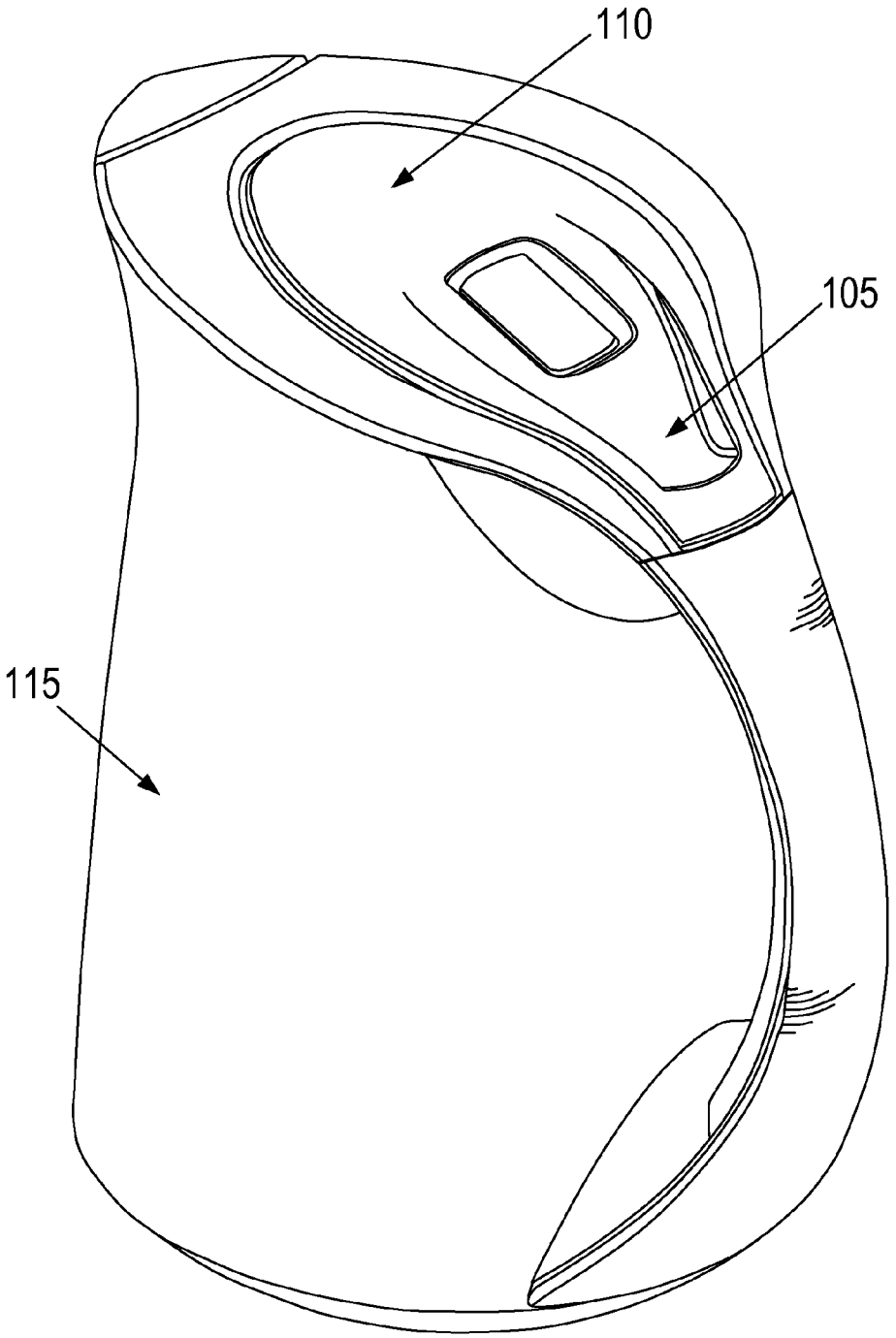
FIGURE 1B Prior Art
FIG. 1B is an illustration of a conventional water dispenser with a curved press member for actuating the lid of the water dispenser.

Compared with conventional pitchers, e.g., the pitcher illustrated in FIG. 1B, the lever on pitcher 300 has a relatively horizontal orientation. Accordingly, lever 305 has a shorter reach than, for example, lever 105 illustrated in FIG. 1B. Also, it allows a user to actuate the flip lid component 310 by applying pressure almost exclusively in the downward direction as opposed to both a sideways and downward direction as required for exemplary lever 105 illustrated in FIG. 1B. Additionally, unlike the conventional pitcher illustrated in FIG. 1B, where the lever 105 and 110 are part of the same component, the lever 305 and the flip lid component 310 are separate components. Thus, unlike the conventional pitcher of FIG. 1B where user would simply actuate a rear portion of the flip lid, in the present invention the user actuates a lever 305 that is a discrete component and separate from the flip lid component 310. Further, another innovation of the present invention is that the distance that lever 305 needs to be depressed to cause the flip lid to open is reduced.

In one embodiment, after flip lid component 310 has been actuated, the flip top lid stays open to 90 degrees without requiring further user intervention. This allows the user to access the upper chamber 270 without, for example, needing to continue holding down lever 305. The user would then have to actuate the flip lid component 310 to a closed position manually. In a different embodiment, the flip lid component 310 could be designed in a way such that it returns to a closed position when the user is not applying pressure to lever 305. When the flip lid component 310 is in a closed position, the lever 305 and the flip lid component 310 are both flush with the fixed lid component 320. In one embodiment, there can be a depression on lever 305, which provides a user with a surface to exert an opening force against, for example, by a user's thumb.

Figure 4:
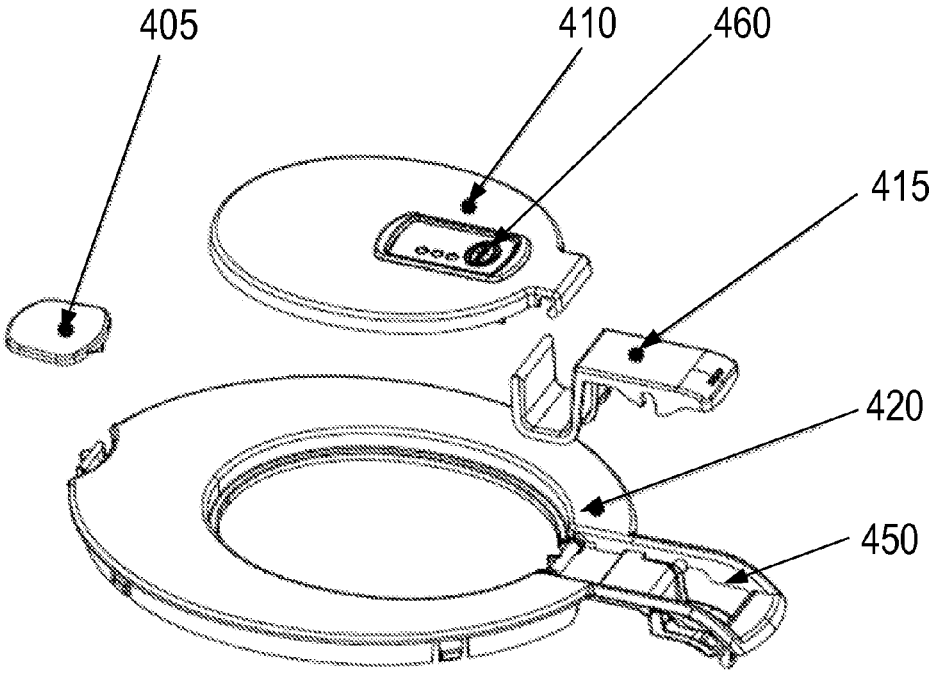
FIG. 4 is an exploded isometric view of the flip top lid assembly of the present invention embodying the principles of the present invention.
Figure 5:
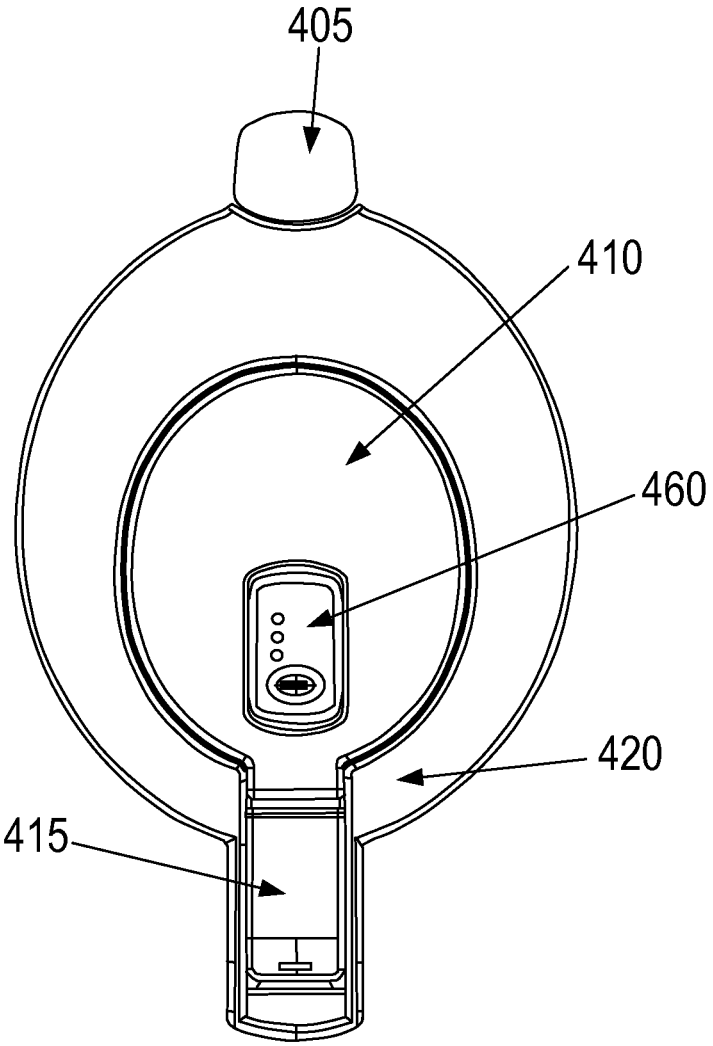
FIG. 5 is a top view of the flip top lid assembly of the present invention embodying the principles of the present invention.

FIG. 4 is an exploded isometric view of the flip top lid assembly of the present invention embodying the principles of the present invention. FIG. 5 is a top view of the flip top lid assembly of the present invention embodying the principles of the present invention.

As illustrated in FIGS. 4 and 5, fixed lid component 420 has a groove 450 into which lever 415 fits. When lever 415 is actuated by the user, flip lid component 410 is pushed upward, thereby, flipping the lid open. In one embodiment, a spout lid 405 is pivotably coupled to fixed lid component 420 to close access to pour spout 220. Spout lid 405, in one embodiment, is designed to pivot when the water dispenser 300 is tilted, such as when a fluent substance is being poured from the dispenser 300. In one embodiment, spout lid 405 is pivoted prior to water engaging spout lid 405 during pouring of water from water dispenser 300. Further, in one embodiment, water dispenser also comprises a filter mechanism monitor 460. This monitor can, for example, be a timer or volumetric indicator for indicating a suggested filter change. Timer may be reset upon each filter change. The monitor 460 can also be used for other purposes, e.g., monitoring an amount of water filtered by filter mechanism 280. The monitor 460 can also comprise indicators for indicating a need for a filter change.

Figures 6A, 6B:
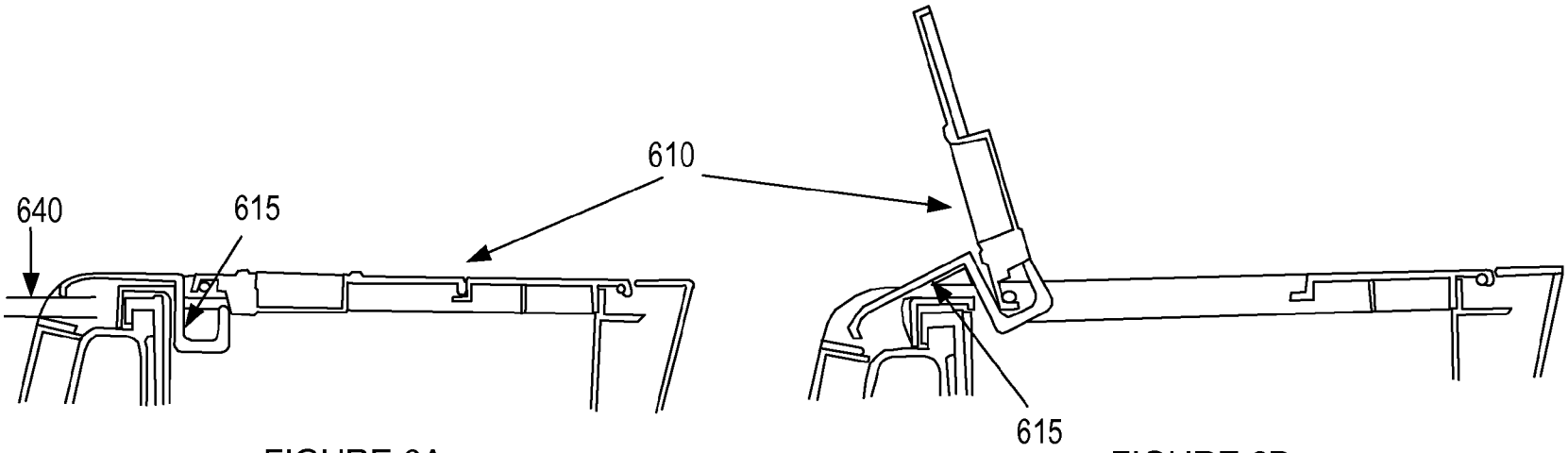
FIG. 6A is a sectional view of the flip top lid assembly of the present invention before the lid has been actuated in accordance with one embodiment of the present invention.
FIG. 6B is a sectional view of the flip top lid assembly of the present invention after the lid has been actuated in accordance with one embodiment of the present invention.

FIG. 6A is a sectional view of the flip top lid assembly of the present invention before the lid has been actuated in accordance with one embodiment of the present invention. By comparison, FIG. 6B is a sectional view of the flip top lid assembly of the present invention after the lid has been actuated in accordance with one embodiment of the present invention. Both FIGS. 6A and 6B illustrate that the inventive flip top lid assembly comprises two parts: lever 615 and flip top lid component 610. As illustrated in FIG. 6A, lever 615 sits in the upper chamber reservoir 270 and may be in contact with the fluent substance filled into upper chamber 270 before it filters into lower chamber 260. As illustrated in FIGS. 6A and 6B, lever 615 only needs to travel a short distance 640 in order to raise flip lid component 610. Accordingly, a user does not need to apply too much downward pressure in order to raise flip lid component 610 open.

Figure 7:
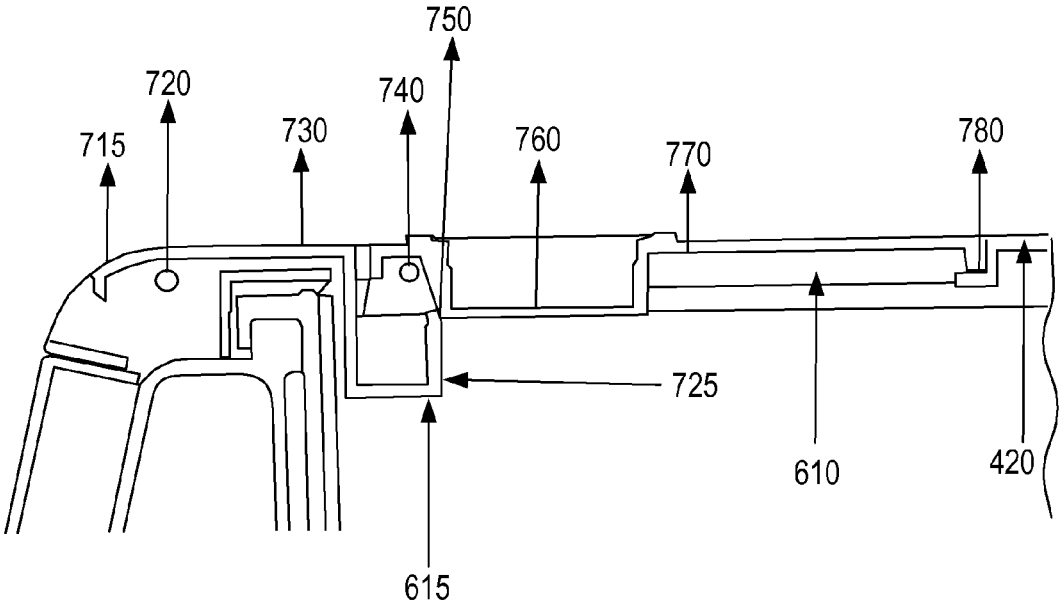
FIG. 7 is another enlarged section view of the lever of the flip top lid assembly in accordance with one embodiment of the present invention.

FIG. 7 is another enlarged section view of the lever of the flip top lid assembly in accordance with one embodiment of the present invention. As discussed above the inventive flip top lid assembly comprises a lever 615 and a flip lid component 610. Lever 615 comprises a press member 715 that the user presses down on in order to actuate lever 615. When press member 715 is depressed, lever 615 pivots around pivot point 720. Lever 615 has a center of gravity at point 730. Lever 615 also comprises a U-shaped portion 725 that sits in the reservoir area of the upper chamber 270. When lever 615 is actuated using press member 715, the U-shaped actuation arm 725 pushes upward and actuates the flip lid component 610 open.

Flip lid component 610 flips open by pivoting around pivot point 740. Lever 615 operatively connects to flip lid component 610 at point 750. The downward force applied to press member 715 is in turn imparted to flip lid component 610 at point 750. The pressure applied to point 750 flips the flip lid component 610 open. The center of gravity of flip lid component 610 occurs at point 770 and at point 780, the flip lid component 610 operatively connects to fixed lid component 420.

As discussed above, the flip lid component 610 can, in one embodiment, comprise a recessed area 760 operable to contain, among other things, a filter mechanism monitor. Filter mechanism monitor would perform substantially the same function as monitor 460 explained in conjunction with FIGS. 4 and 5.

Figure 8B:
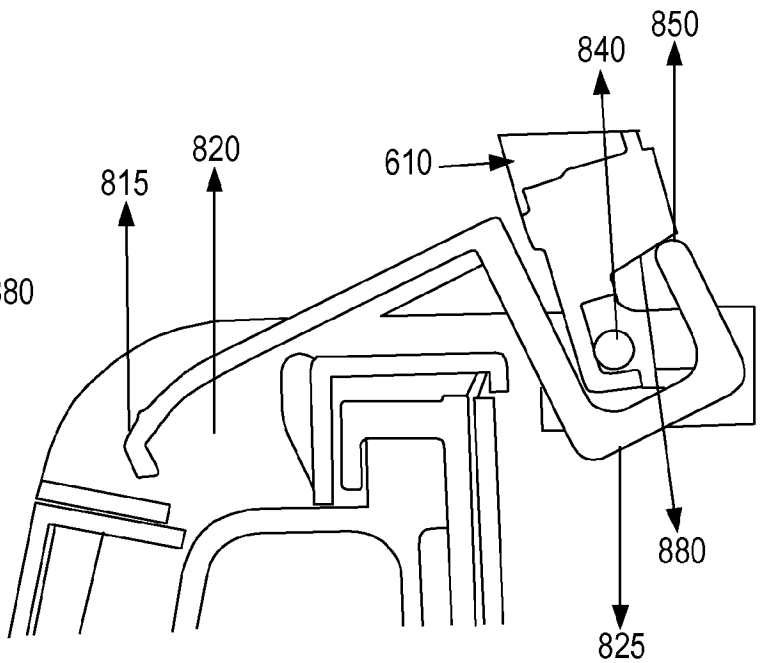
FIG. 8B is an enlarged section view of the lever of the flip top lid assembly of the present invention after the lever has been actuated to open the lid in accordance with one embodiment of the present invention.
Figure 8A:
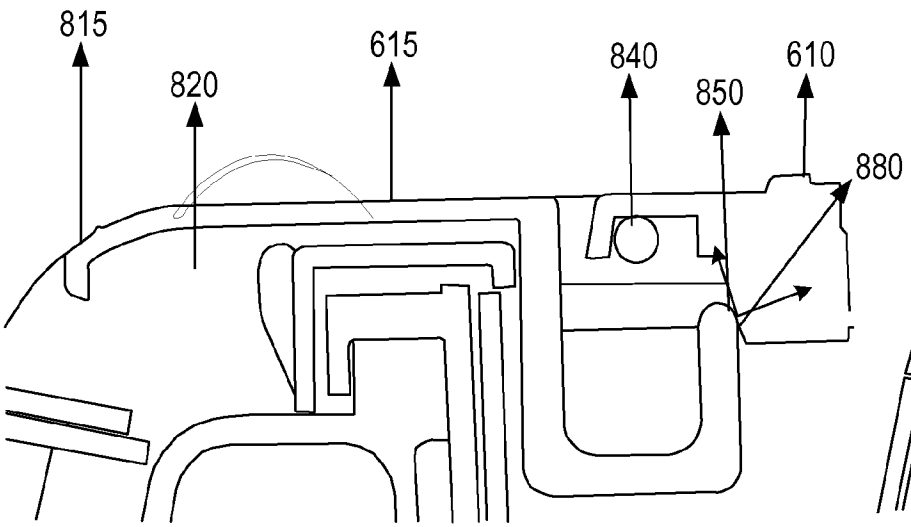
FIG. 8A is an enlarged section view of the lever of the flip top lid assembly of the present invention before the lever has been actuated to open the lid in accordance with one embodiment of the present invention.

FIG. 8A is an enlarged section view of the lever of the flip top lid assembly of the present invention before the lever has been actuated to open the lid in accordance with one embodiment of the present invention. Further, FIG. 8B is an enlarged section view of the lever of the flip top lid assembly of the present invention after the lever has been actuated to open the lid in accordance with one embodiment of the present invention.

The user actuates lever 615 by pressing down on press member 815, thereby, causing lever 615 to pivot around pivot point 820. The U-shaped arm 825 of lever 615 operatively connects with the flip lid component 610 at point 850. The U-shaped arm 825 slides along the ramped surface 880 of the flip lid component to begin lifting by pivoting around point 840. As the flip lid component 615 begins to lift and pivot around point 840, the force becomes less sliding and more direct force is applied at contact point 850 in order to fully raise the flip lid component. Accordingly, substantially all the pressure applied by the user on press member 815 is in a downward direction.

An inventive water dispenser cover is thus provided in a cost effective and reliable manner. The inventive cover comprises a flip top lid component actuated using a lever that is operatively connected with the flip top lid component. The lever can be actuated easily by a user, wherein substantially all the pressure applied by the user to the lever is in a downward direction. By allowing for separate components for the flip top lid and the lever, the inventive cover allows for a shorter and more comfortable reach as compared with conventional pitchers wherein the lid was actuated using a rear portion of the lid. Further, the flip top lid component will stay open to 90 degrees after it has been actuated by the lever and will remain in that position until the user flips the flip top lid component back down manually.

Figure 9:
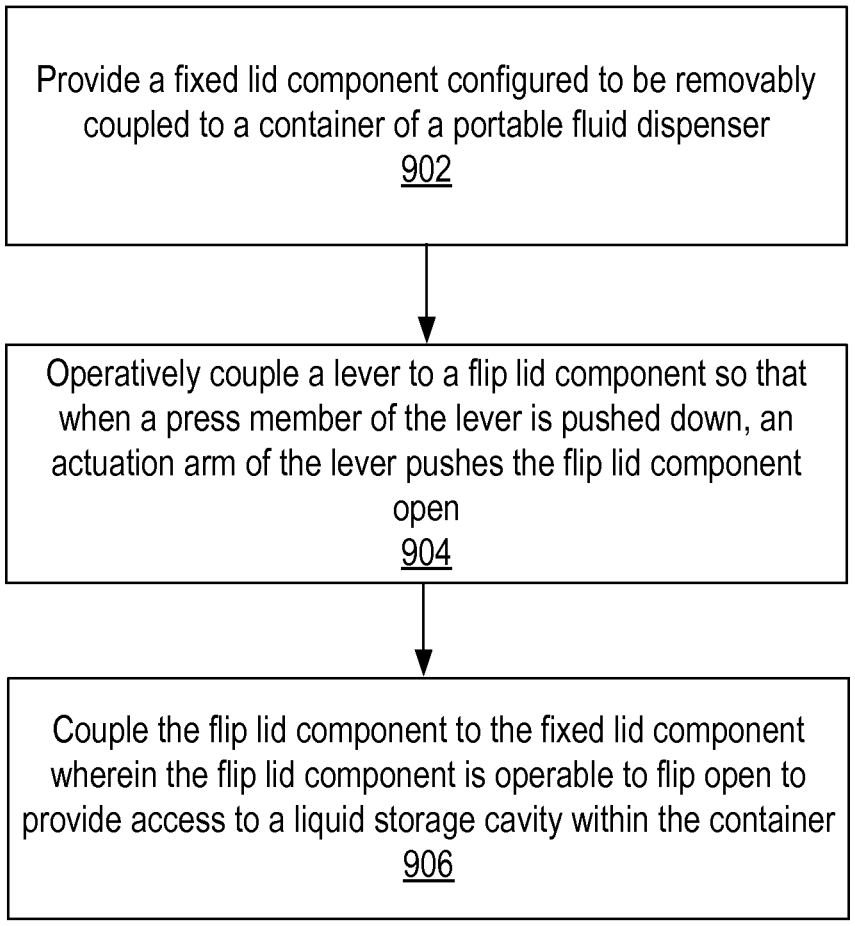
FIG. 9 depicts a flowchart of an exemplary process of assembling a cover for a portable fluid dispenser in accordance with one embodiment of the present invention.

FIG. 9 depicts a flowchart of an exemplary process of assembling a cover for a portable fluid dispenser in accordance with one embodiment of the present invention. The invention, however, is not limited to the description provided by flowchart 900. Rather, it will be apparent to persons skilled in the relevant art(s) from the teachings provided herein that other functional flows are within the scope and spirit of the present invention. Flowchart 900 will be described with continued reference to exemplary embodiments described above, though the method is not limited to those embodiments.

At step 902, a fixed lid component 420 for the cover of the portable fluid dispenser is provided. The fixed lid component is configured to be removably coupled to the container portion 215 of the portable fluid dispenser.

At step 904, a lever 415 is operatively coupled with a flip lid component 410. Lever 415 comprises press member 715 on one end and an actuation arm 725 that is U-shaped. When a user actuates the press member 715, the lever rotates around a pivot point 720. This rotation causes the actuation arm 725 to push on flip lid component 410 at actuation point 750. The flip lid component is then caused to pivot around a second pivot point 740 and rotates open in response to the resulting force applied at actuation point 750 by the actuation arm 725.

Finally, at step 906, the flip lid component 410 is coupled to the fixed lid component 420. The flip lid component rotates open to provide access to a liquid storage cavity within the container portion 215. As illustrated in FIG. 4, the fixed lid component 420 forms an outer ring around the flip lid component 410. Further when flip lid component 410 is in a closed position it is flush with the fixed lid component 420.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware configurations. In addition, any disclosure of components contained within other components should be considered as examples because many other architectures can be implemented to achieve the same functionality.

The process parameters and sequence of steps described and/or illustrated herein are given by way of example only. For example, while the steps illustrated and/or described herein may be shown or discussed in a particular order, these steps do not necessarily need to be performed in the order illustrated or discussed. The various example methods described and/or illustrated herein may also omit one or more of the steps described or illustrated herein or include additional steps in addition to those disclosed.

It should also be understood, of course, that the foregoing relates to exemplary embodiments of the invention and that modifications may be made without departing from the spirit and scope of the invention as set forth in the following claims.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as may be suited to the particular use contemplated.

Embodiments according to the invention are thus described. While the present disclosure has been described in particular embodiments, it should be appreciated that the invention should not be construed as limited by such embodiments, but rather construed according to the below claims.

What is claimed is:

1. A cover for a portable fluid dispenser, said cover comprising: a fix lid component configured to be removable coupled to a container opening of said portable fluid dispenser;

a flip lid component pivotally coupled to said fixed lid component and being operable to rotate open to provide access to a liquid storage cavity of said portable fluid dispenser; and a lever operatively coupled to said flip lid component, wherein said lever comprises a press member on one end and an actuation arm on a far end of said lever opposite from said press member, wherein a downward force applied to said press member causes said lever to rotate around a first pivot point, and further wherein rotation of said lever around said first pivot point causes said actuation arm to push on said flip lid component at an actuation point, wherein further said flip lid component pivots around a second pivot point and rotates open in response to a resulting force applied at said actuation point, and further wherein said second pivot point is located on said fixed lid component inward of said first pivot point toward said liquid storage cavity and wherein location of contact between said actuation arm and said actuation point is inward of said second pivot point as the downward force is applied to said press member; and wherein an end of said flip lid component proximate to said actuation arm rotates and recedes into a U-shaped recess in said actuation arm when it opens in response to said resulting force applied at said actuation point, wherein said U-shaped recess is located underneath said flip lid component in a reservoir area of said fluid dispenser.

2. The cover of claim 1, wherein said fixed lid component forms an outer ring around said flip lid component, and wherein said fixed lid component is substantially flush with said flip lid component when said flip lid component is in a closed position.

3. The cover of claim 2, wherein said fixed lid component comprises a groove into which said lever fits, and wherein said press member of said lever is substantially flush with said flip lid component and said fixed lid component when said flip lid component is in said closed position.

4. The cover of claim 1, further comprising a spout lid, wherein said spout lid is pivotably coupled to said fixed lid component at an opposite end from said lever, wherein said spout lid is operable to pivot when said fluid dispenser is tilted.

5. The cover of claim 1, further comprising a monitor, wherein said monitor is operable to indicate a time for a suggested filter change.

6. The cover of claim 1, wherein said actuation arm connects with said flip lid component at said actuation point, wherein said actuation point is located on a ramped surface of said flip lid component, and wherein a force vector between said actuation arm and said ramped surface of said flip lid component at said actuation point is at an angle with respect to a horizontal axis of said flip lid component in a closed position.

7. The cover of claim 6, wherein said actuation arm actuates said flip lid component by sliding along said ramped surface starting at said actuation point and pushing upward on said ramped surface to rotate said flip lid component open.

8. A method of assembling a cover for a portable fluid dispenser, said method comprising:

providing a fixed lid component for said cover configured to be removably coupled to a container of said portable fluid dispenser;

operatively coupling a lever to a flip lid component, wherein said lever comprises a press member on one end and an actuation arm on a far end of said lever opposite from said press member, wherein a downward force on said press member causes said lever to rotate around a first pivot point, and further wherein a rotation of said lever around said first pivot point causes said actuation arm to push on said flip lid component at an actuation point, wherein further said flip lid component pivots around a second pivot point and rotates open in response to a resulting force applied at said actuation point, said second pivot is located on said fixed lid component inward of said first pivot point toward said liquid storage cavity and wherein location of contact between said actuation arm and said actuation point is inward of said second pivot point as the downward force is applied to said press member; and coupling said flip lid component to said fixed lid component, wherein said flip lid component is operable to rotate open to provide access to a liquid storage cavity within said container, wherein said fixed lid component forms an outer ring around said flip lid component, and wherein said fixed lid component is substantially flush with said flip lid component when said flip lid component is in a dosed position; and wherein an end of said flip lid component proximate to said actuation arm rotates and recedes into a U-shaped recess in said actuation arm when it opens in response to said resulting force applied at said actuation point, wherein said U-shaped recess is located underneath said cover in a reservoir area of said fluid dispenser.

9. The method of claim 8, further comprising:

pivotably coupling a spout lid to said fixed lid component at an opposite end of said cover from said lever, wherein said spout lid is operable to pivot when said fluid dispenser is tilted.

10. The method of claim 8, wherein said fixed lid component comprises a groove into which said lever fits, and wherein said press member of said lever is substantially flush with said flip lid component and said fixed lid component when said flip lid component is in said closed position.

11. The method of claim 8, further comprising:

providing a monitor, wherein said monitor is operable to indicate a time for a suggested filter change and wherein said monitor is operatively coupled to said flip lip component.

12. The method of claim 8, wherein said actuation arm connects with said flip lid component at said actuation point, wherein said actuation point is located on a ramped surface of said flip lid component, and wherein a force vector between said actuation arm and said ramped surface of said flip lid component at said actuation point is at an angle with respect to a horizontal axis of said flip lid component in a closed position.

13. A portable fluid dispenser comprising:

a container body defining a liquid storage cavity therein and having an open end; a cover removably coupled to said container body, said cover extending along said open end, said cover comprising;

a flip lid component operable to rotate open to provide access to said liquid storage cavity of said portable fluid dispenser;

a fixed lid component, wherein said fixed lid component forms an outer ring around said flip lid component, and wherein said fixed lid component is substantially flush with said flip lid component when said flip lid component is in a closed position; and a lever operatively coupled to said flip lid component, wherein said lever comprises a press member on one end and an actuation arm on a far end of said lever opposite from said press member, wherein a downward force on said press member causes said lever to rotate around a first pivot point, and further wherein a rotation of said lever around said first pivot point causes said actuation arm to push on said flip lid component at an actuation point, wherein said flip lid component pivots around a second pivot point and rotates open in response to a resulting force applied at said actuation point, and wherein said second pivot point is located on said fix lid component inward of said first pivot point toward said liquid storage cavity and wherein location of contact between said actuation arm and said actuation point is inward of said second pivot point as the downward force is applied to said press member; and wherein an end of said flip lid component proximate to said actuation arm rotates and recedes into a U-shaped recess in said actuation arm when it opens in response to said resulting force applied at said actuation point, wherein said U-shaped recess is located underneath said flip lid component in a reservoir area of said fluid dispenser.

14. The portable fluid dispenser of claim 13, wherein said container body further comprises:

an upper chamber proximate to said cover, wherein a fluent substance in said upper chamber is separated from a fluent substance in a lower chamber, and wherein said upper chamber is in fluid communication with said lower chamber via a filter mechanism, wherein said filter mechanism is used to channel an unpurified fluent substance from said upper chamber to said lower chamber.

15. The portable fluid dispenser of claim 13, wherein said container further comprises:

a handle; and a spout opening for dispensing a fluent substance.

16. The portable fluid dispenser of claim 13, wherein said fixed lid component comprises a groove into which said lever fits, and wherein said press member of said lever is substantially flush with said flip lid component and said fixed lid component when said flip lid component is in a closed position.

17. The portable fluid dispenser of claim 13, wherein said cover further comprises a spout lid, wherein said spout lid is pivotably coupled to said fixed lid component at an opposite end of said cover from said lever, wherein said spout lid is operable to pivot when said fluid dispenser is tilted.

18. The portable fluid dispenser of claim 13, wherein said cover further comprises a monitor, wherein said monitor is operable to indicate a time for a suggested filter change.

19. The portable fluid dispenser of claim 13, wherein said flip lid component stays open after it rotates open even if said downward force is no longer applied.

* * * * *